US006454903B2

(12) United States Patent
Mohrsen et al.

(10) Patent No.: US 6,454,903 B2
(45) Date of Patent: Sep. 24, 2002

(54) METHOD AND APPARATUS FOR THE TRANSFER OF A LEAD STRIP OF A PAPER WEB

(75) Inventors: Leif Mohrsen, Surrey; Allan Broom, Coquitlam, both of (CA)

(73) Assignee: Voith Paper Patent GmbH, Heidenheim (DE)

( * ) Notice: Subject to any disclaimer, the term of this patent is extended or adjusted under 35 U.S.C. 154(b) by 7 days.

(21) Appl. No.: 09/775,088

(22) Filed: Feb. 1, 2001

(30) Foreign Application Priority Data

Feb. 2, 2000 (DE) ..... 100 04 369

(51) Int. Cl.[7] ..... D21F 1/36; D21F 7/00; D21F 1/42; D21F 2/00; B65H 20/14

(52) U.S. Cl. ..... 162/193; 162/289; 34/114; 34/117; 34/120; 34/122; 226/7; 226/91; 226/97.1; 226/97.3

(58) Field of Search ..... 162/193, 199, 162/272, 275, 278–279, 289; 34/114, 117, 120, 122; 226/97.3, 91, 7, 97.1

(56) References Cited

U.S. PATENT DOCUMENTS 4,014,487 A * 3/1977 Reba et al. ..... 226/5
4,501,643 A * 2/1985 Kiuru ..... 162/286
4,543,160 A * 9/1985 Kerttula et al. ..... 162/193
4,692,215 A * 9/1987 Kerttula ..... 162/289
4,698,918 A * 10/1987 Kotitschke et al. ..... 34/116
4,726,502 A * 2/1988 Cryderman ..... 226/97
4,904,344 A * 2/1990 Peiffer ..... 162/193
4,923,567 A * 5/1990 Liedes et al.
4,997,524 A * 3/1991 Nieminen et al. ..... 162/193
5,404,811 A 4/1995 Schiel et al. ..... 100/163 R
5,503,716 A * 4/1996 Kivimaa et al. ..... 162/358.1
5,635,030 A 6/1997 Meschenmoser ..... 162/193
5,989,393 A * 11/1999 Kivimaa et al. ..... 162/360.2
6,131,784 A * 10/2000 Helgesson et al. ..... 226/91
6,379,502 B1 * 4/2002 Satzger et al. ..... 162/193

FOREIGN PATENT DOCUMENTS

EP 0 364 114 A1 4/1990
WO WO 99/20834 4/1999

* cited by examiner

*Primary Examiner*—Jose Fortuna
(74) *Attorney, Agent, or Firm*—Taylor & Aust P.C.

(57) ABSTRACT

An apparatus transfers a lead strip of a paper web, in particular the beginning of a still wet lead strip or tail, from a press roll of a paper-making machine to a following section of that machine. An air jet device peels off the beginning of the tail from the press roll and transfers it across a paper roll to an infeed area of a felt which guides the web into the following section. On an infeed area of the felt, an air cushion is created by an air table having a plurality of tiny holes delivering air from a low pressure plenum to the air cushion.

15 Claims, 2 Drawing Sheets

METHOD AND APPARATUS FOR THE TRANSFER OF A LEAD STRIP OF A PAPER WEB

BACKGROUND OF THE INVENTION

1. Field of the Invention

The present invention relates to a method and apparatus for transferring a lead strip of a paper-web from a first traveling surface (e.g., of a press roll or of a press belt) of a paper-making machine to a following section (e.g., a further wet press or drying section) of that machine. In particular, the beginning of a still wet lead strip (or "tail") is transferred according to the invention. This is to facilitate the threading of the paper web into the machine.

2. Description of the Related Art

In a dewatering press section of a papermaking machine, as disclosed in FIG. 1 of U.S. Pat. No. 5,404,811, a still wet paper web 9 travels from a wire belt 8 of a forming section through three press nips 16/17, 1/2 and 2/3 and thereafter via a paper roll 59 to a further dewatering press 60; then the still wet web is transferred to a drying section (not shown). When the machine is started up or after a web break, the web is threaded into the machine in a known manner:

Initially the web (having the full web width) is running behind the third press nip downwardly and is guided by a doctor 14 into a broke pulper (not shown, positioned below the machine). The web includes a small edge strip, namely the so-called lead strip or "tail", severed from the web by a water jet positioned in the forming section. This tail is now transferred across paper roll 59 and via a bottom press felt through press 60 as well as through the following drying section. Then the width of the tail is increased up to the full width of the web.

During the threading operation, the web is already running with the full machine speed which may be more then 1000 m/min, in modem high speed machines up to about 2000 m/min. Therefore, the transfer of the tail from press roll 2 to the press felt of press 60 is a very difficult step of the threading operation. Sometimes this is done manually by means of an air jet being directed onto the surface of roll 2, thusly severing the tail and forming a new beginning of the tail guided across paper roll 59 to the further press 60.

A modem high speed paper-making machine normally comprises an apparatus for carrying out this difficult step. One known apparatus of this type is disclosed in FIG. 2 of U.S. Pat. No. 5,635,030. Here again, a paper web 1 is traveling downwardly across a press roll 5 from a press nip toward a doctor 7. A blast nozzle 6 (or "separating blow pipe") is provided to peel off the tail from press roll 5 and to transfer the tail to paper roll 2. A further blast nozzle 3 is arranged between the two rolls 5 and 2, which blast nozzle creates an air stream, the velocity of which is greater than the velocity of paper roll 2. Due to the Coanda-Effect, the air stream adheres to the rotating shell of paper roll 2 and guides the tail up to a stationary guide plate 9 which deflects the air stream and the tail toward subsequent press unit 8.

The method and the apparatus disclosed in the '030 patent have some disadvantages. Among others, two blast nozzles are needed, one being positioned between the press roll 5 and the paper roll 2. Also, there is a large distance between the paper roll 2 and the infeed area of the press felt 17 of the following press 8. As a result, the tail transfer to the following press may not always be successful in a reliable manner.

In another concept, only a short distance has been provided between the paper roll and the infeed area of the following press felt. In other words, a felt roll guiding the following press felt to the following press has been arranged relatively close to the paper roll (as shown in FIG. 1 of the '811 patent). Also, an air cushion has been created onto the infeed area by means of a series of blast nozzles. However, this design also does not always operate satisfactorily. Also, a so-called pony roll has been suggested to be arranged on the infeed area instead of an air cushion, however this is mechanically complicated and therefore not desirable.

SUMMARY OF THE INVENTION

The present invention significantly improves the transfer of a tail from a first traveling surface to a following machine section by use of a novel method and by use of an improved apparatus which operates more reliably than previous proposals.

The method requires little operator skill. Thus, inexperienced personnel are able to start the threading operation without a lot of practice.

The threading operation is easily started by a reliable transfer of the tail, even with different paper grades (e.g., different basis weight) and with different machine speeds, including extremely high speed (e.g., more than 2000 m/min).

A lead strip or 'tail'b of a paper web is transferred from a first traveling surface of an element of a paper-making machine to an infeed area of a second traveling surface which guides the tail into a following machine section.

The first traveling surface is the surface of a rotatable shell of a press roll which directly contacts the still wet paper web and which is part of a web dewatering press. It may also be the surface of a press belt traveling through a press nip of a web dewatering press.

The second traveling surface is the web-carrying surface of a dewatering press felt which guides the web through a subsequent dewatering press. However, the second traveling surface may also be the surface of a subsequent press roll or of a subsequent press belt. In another embodiment of the invention, the second traveling surface is the surface of a dryer fabric which guides the web through a part of a dryer section following the press section of the paper-making machine.

The method of the present invention includes providing at least one air jet for peeling off of the tail from the first traveling surface and for transferring it across a rotating paper roll to the infeed area of the second traveling surface. More particularly, the air jet initially severs the tail running with the first traveling surface, thereby forming a new beginning of the tail which is now transferred to the second traveling surface.

An air cushion is provided on the infeed area of the second traveling surface. The air cushion is created by an air table having a plurality of tiny orifices delivering air from an air plenum to the air cushion. According to the invention, the air cushion a created by a large number of tiny orifices which connect the air plenum to the air cushion and which are distributed substantially equally on the air table. This results in a significant advantage, namely that the oncoming tail (including its new beginning) is forced to lay on the second traveling surface with only a small amount of air moving with the second traveling surface. Therefore, the tail, which is running at the high machine speed together with the second traveling surface, is reliably pressed onto the second traveling surface. In other words, the air does not bounce off the second traveling surface and the tail is not lifted with the air. Such an undesirable behavior would result from creating an air cushion by use of a series of blast nozzles which deliver too much air at a too high pressure.

Too much air is also not directed into the following machine section, e.g., into a further dewatering press. Therein the press nip (or a similar wedge-like gap) would cause the air to flow sideways and to take the tail with it. This could happen both before the beginning of the tail has arrived in the press nip and thereafter.

In summary, the method of the invention results in a very easy and reliable transfer of the tail so that the transfer does not need much operator skill. Also, the transfer works well with different paper grades and with different machine speeds including the high speed of modem paper machines.

The present invention also includes an apparatus for transferring the tail as described above. The apparatus includes a peeling jet device for providing the at least one air jet as mentioned above. The peeling jet device is arranged close to the first traveling surface (e.g., the surface of the press roll).

The apparatus further includes a conventional paper roll which guides the web between the first and second traveling surfaces. The most important element of the apparatus of the invention is a so-called air table having a large number of tiny holes which connect an air plenum with the infeed area of the second traveling surface, thereby creating an air cushion which is almost stationary on the second traveling surface. This results in the advantages described above.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
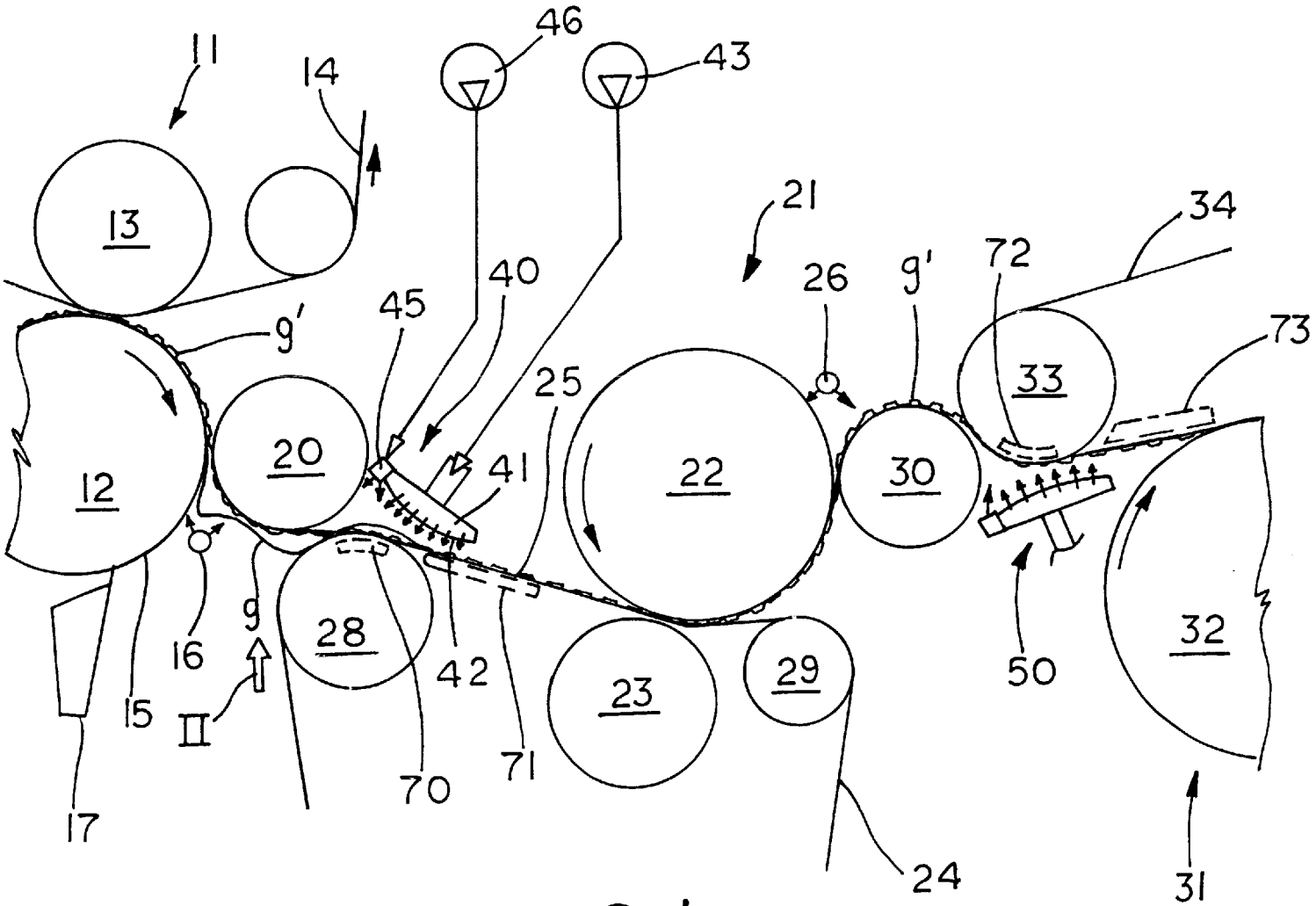
FIG. 1 is a schematic side view of two dewatering presses of a paper-making machine including an air table.

In FIG. 1, the normal path of a paper web to be dewatered in two presses 11 and 21 is shown as a broken line and designated 9'. Web 9' is traveling through the nip of a top-felted press 11 including a bottom press roll 12 (which directly contacts the web) and a top press roll 13 positioned in the loop of an endless dewatering felt 14. Bottom press roll 12 includes a (downwardly) "first traveling surface" 15. Close to it, a peeling jet device 16 and a conventional doctor 17 are arranged.

A subsequent dewatering press 21 is bottom felted. It includes a top press roll 22 (which directly contacts the web) and a bottom felt 24 guided by felt rolls 28 and 29, one (28) of which is positioned near the bottom press roll 12 of press 11. The part of felt 24 traveling from felt roll 28 to the nip of press 21 forms a so-called "second traveling surface" 25 including a so-called "infeed area" (positioned on felt roll 28) wherein the web comes into contact with felt 24. Web 9' is guided by a paper roll 20 from the first (15) to the second (25) traveling surface. There is a short distance between surface 15 and roll 20 as well as between roll 20 and surface 25.

Behind press 21, web 9' is traveling across a further paper roll 30 to a dryer fabric 34 running across a fabric toll 33 transferring the web to a first drying cylinder 32 of a drying section 31.

Normally, at least one further press nip (not shown) may be arranged upstream of press 11. Typically, press 11 forms a third press nip of a complete press section; then press 21 forms a fourth press nip.

Before the web 9' is traveling along its normal path it runs across press roll 12 and doctor 17 downwardly into a broke pulper (not shown). For threading the web into the bottom felted press 21 (and further to dryer section 31) an edge strip on "tail 9" of the web is severed by peeling jet device 16, peeled off from the first traveling surface 15 and transferred to the second traveling surface 25. An air table 40 extends along the infeed area of the second traveling surface 25 of felt 24. The air table also extends from paper roll 20 across the gap between paper roll 20 and felt 24 at felt roll 28. The width of air table 40 is slightly larger than the width of the tail 9 (see FIG. 2).

The air table 40 includes a box 41 connected to an air pressure source 43 providing a relatively low air pressure, the box 41 thusly forming a so-called air plenum, wherein the air pressure is preferably between 5 and 20 psi.

Box 41 includes a convex wall 42 facing towards felt 24, the convex wall having a plurality of tiny holes 44 or orifices. The diameter of each hole may be about 0.5 to 2 mm; the percentage of open area, i.e., the total of the cross-sectional areas of throughholes 44 as a percentage of the surface area of the perforated surface of the air table, is about 0.03% to 0.1%. Thereby a stable air cushion is created between air table 40 and the traveling surface 25 of felt 24 pressing the tail onto felt 24 without moving much air toward the nip of press 21. As a further improvement, box 41 is arranged in such a way that the air cushion formed between box 41 and surface 25 is converging with respect to the web travel direction. Close to paper roll 20, an air jet pipe 45 is mechanically connected to box 41, the pipe 45 being connected to a high pressure source 46. Peeling jet device 16 may also be connected (not shown) to high pressure source 46.

Air jet pipe 45 may provide an air jet approximately tangential to the shell or outer surface of paper roll 20 contrary the travel direction of the shell. At most one further air jet or air curtain may be directed from pipe 45 or from an additional pipe 67 (FIG. 3) toward the infeed area, i.e., toward felt roll 28. Peeling jet device 16 produces an air jet approximately perpendicular to the first traveling surface 15. If needed, jet device 16 may additionally create an air jet toward paper roll 20.

In order to further improve the reliable transfer of the tail to the second traveling surface 25 or 34, it may he helpful to provide suction devices (70–73) in the area of the tail within roll 28 and/or within roll 33 and/or beneath felt 24 and/or fabric 34.

In order to facilitate the transfer of tail 9 from press roll 30 to the drying fabric 34, a further peeling jet device 26 is arranged close to the surface of press roll 22. Also, a further air table 50 may be arranged below fabric roll 30. In this case, press roll 22 forms the first traveling surface and the drying fabric 34 forms the second traveling surface.

Figure 2:
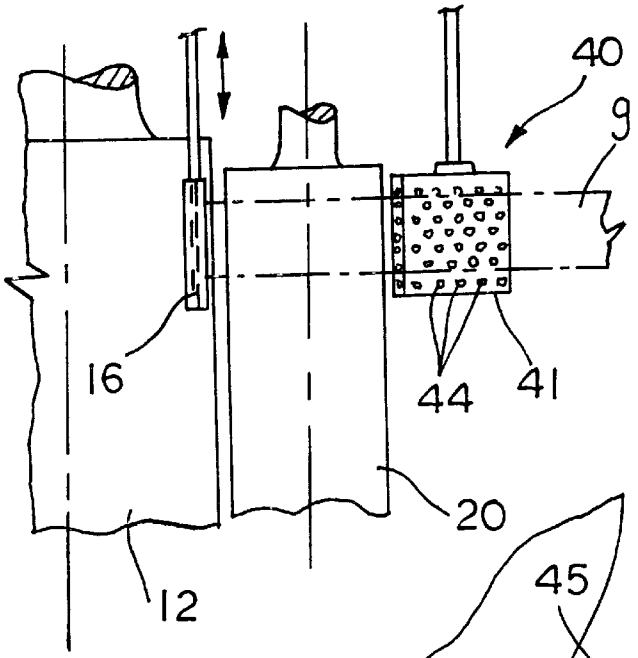
FIG. 2 is a schematic view along arrow II of FIG. 1.

FIG. 2 shows the peeling jet device 16 air the air table 40 in their operating position held during a threading operation.

During the normal operation of the paper-making machine, the peeling jet device 16 is removed to the outside of the machine. For this purpose, a pneumatic cylinder (not shown) or a similar equipment is provided which moves the device 16 automatically into or out of its operating position, as indicated by a double arrow. If needed, the air table 40 may also be connected to a pneumatic cylinder.

Figure 3:
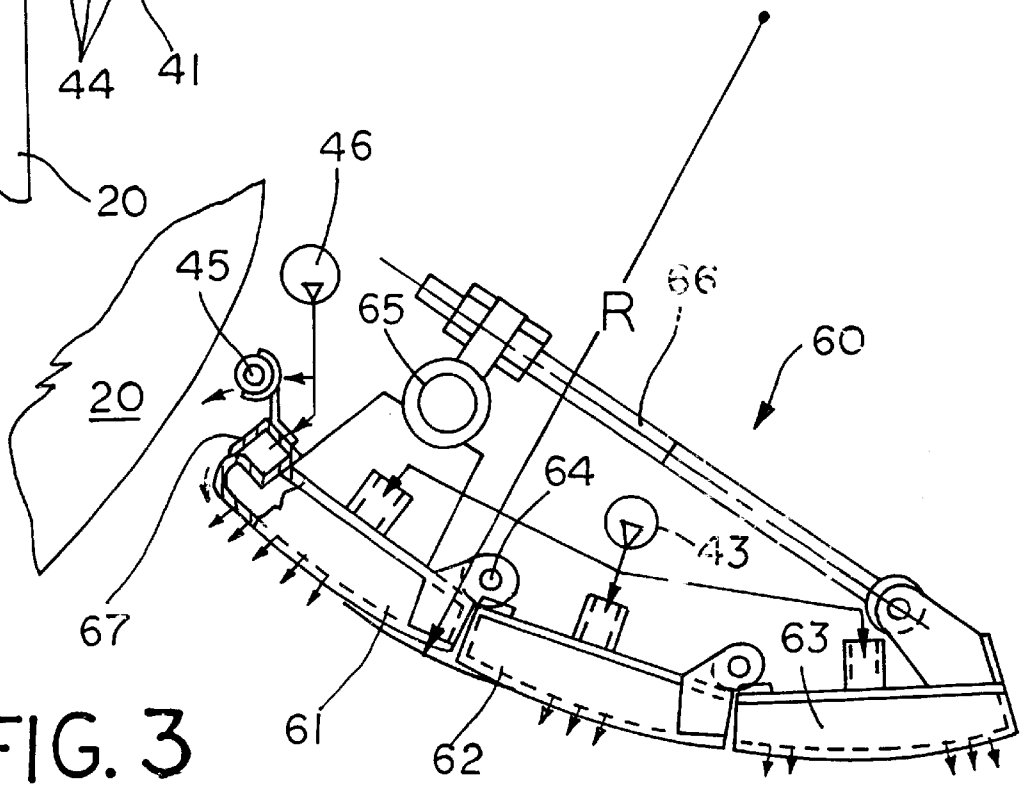
FIG. 3 is a side schematic view of a segmented air table.

FIG. 3 shows a further developed air table 60. It is divided into various (e.g., three) segments 61 through 63. Each segment is formed as a box similar to box 41 of FIGS. 1 and 2. One (61) of the boxes is mechanically connected to a supporting device 65 which supports the complete air table 60 and which may be connected (if needed) to a pneumatic cylinder (not shown) of the type explained above. The segments 61 and 62 as well as the segments 62 and 63 are mechanically connected one to the other by a pivot 64. Also, the outer end of the third segment 63 is connected to support 65 by a spindle 66 (or threaded bolt). Therefore, the distance between the outer end of segment 63 and support 65 may be changed. In other words, the average radius R of the curvature of the complete air table 60 may be changed. This allows the user to change the form of the complete air table 60 in order to adapt the same to various operating conditions, e.g., to various paper grades or to various machine speeds. As an example, the form of the complete air table may be approximately flat. The segments 61-63 may be provided with equal air pressure or with different air pressures. Finally, it is possible to create air tables of different size by using a different number of segments (e.g., two or three or four, etc.).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper-making machine, a method of transferring a beginning of a wet lead strip of a paper web from a first moving surface to a following section of the machine, said method comprising the steps of:

peeling off the beginning of the lead strip from the first moving surface, said peeling being performed using at least one air jet;

transferring the beginning of the lead strip across a paper roll to an infeed area of a second moving surface, said transferring being performed using said at least one air jet;

guiding the web into the following section using said second moving surface;

creating an air cushion in said infeed area of said second moving surface, said creating step being performed using an air table having a plurality of throughholes; and delivering air through said throughholes from an air plenum to said air cushion.

2. The method of claim 1, wherein said creating step is performed using said throughholes of said air table, said throughholes being substantially evenly spaced across said air table.

3. The method of claim 1, comprising the further step of providing an air pressure of approximately between 5 pounds per square inch and 20 pounds per square inch in said air plenum.

4. The method of claim 1, wherein said delivering step includes delivering the air from said air plenum through said throughholes substantially vertically onto said second moving surface.

5. An apparatus for transferring a beginning of a wet lead strip of a paper web from a first moving surface to a following section of a paper-making machine, said apparatus comprising:

a peeling jet device configured for peeling off the beginning of the lead strip from the first moving surface and for transferring the beginning of the lead strip across a paper roll to an infeed area of a second moving surface in the following machine section;

an air table extending along said infeed area, said air table having a perforated surface with a plurality of throughholes; and an air pressure source in fluid communication with said second moving surface via said throughholes.

6. The apparatus of claim 5, wherein said paper roll and said infeed area of said second moving surface define a gap therebetween, said air table extending from said paper roll across said gap and along said infeed area of said second moving surface.

7. The apparatus of claim 5, wherein said air table is curved, said throughholes being arranged at a convex side of said air table.

8. The apparatus of claim 5, further comprising an air jet device configured for directing an air jet onto a surface of said paper roll, said air table supporting said air jet device.

9. The apparatus of claim 8, wherein said air jet device is configured for directing the air jet substantially tangentially onto said surface of said paper roll, the air jet having a direction substantially opposite to a direction of movement of said surface of said paper roll.

10. The apparatus of claim 5, further comprising an air curtain device configured for providing an air curtain flowing along said perforated surface of said air table in a direction of web travel, said air table supporting said air curtain device.

11. The apparatus of claim 5, wherein said air table includes at least two segments and a pivot interconnecting said segments, said pivot being configured for enabling a change in an average radius of curvature of said air table.

12. The apparatus of claim 5, wherein said throughholes have respective diameters approximately between 0.5 mm and 2 mm.

13. The apparatus of claim 5, wherein said throughholes have respective cross-sectional areas, a total of said cross-sectional areas being approximately between 0.03% and 0.1% of a surface area of said perforated surface of said air table.

14. The apparatus of claim 5, wherein said air table is configured for forming an air cushion between said air table and said second moving surface, said air cushion converging in a direction of web travel.

15. The apparatus of claim 5, further comprising at least one suction device associated with said second traveling surface and with the lead strip.

* * * * *